US008727301B2

(12) United States Patent
Arslankiray et al.

(10) Patent No.: US 8,727,301 B2
(45) Date of Patent: May 20, 2014

(54) BUILT-IN HOME APPLIANCE

(75) Inventors: Ziya Arslankiray, Tekirdag (TR); Alper Erdem, Istanbul (TR); Tolga Yegin, Izmir (TR)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 137 days.

(21) Appl. No.: 13/405,381

(22) Filed: Feb. 27, 2012

(65) Prior Publication Data

US 2012/0248264 A1 Oct. 4, 2012

(30) Foreign Application Priority Data

Mar. 31, 2011 (TR) ..... 2011 03077

(51) Int. Cl.
*F16M 11/00* (2006.01)

(52) U.S. Cl.
USPC ..... 248/677; 248/188.2; 248/188.4; 126/304 A

(58) Field of Classification Search
USPC ..... 248/544, 677, 398, 188.2, 188.4, 248/346.05; 16/19; 126/304 A; 312/247, 312/351.7, 401
See application file for complete search history.

(56) References Cited

U.S. PATENT DOCUMENTS

| | | | | | |
|---|---|---|---|---|---|
| 1,907,754 | A * | 5/1933 | Dina | 248/650 |
| 2,803,510 | A * | 8/1957 | Carbary | 312/351.13 |
| 2,847,796 | A * | 8/1958 | Matter | 248/646 |
| 3,186,670 | A * | 6/1965 | Perl | 248/188.2 |
| 3,534,430 | A * | 10/1970 | Livesay et al. | 16/34 |
| 3,750,989 | A * | 8/1973 | Bergeson | 248/650 |
| 4,748,715 | A * | 6/1988 | Rice | 16/19 |
| 4,991,805 | A * | 2/1991 | Solak et al. | 248/188.4 |
| 5,292,095 | A * | 3/1994 | Cattaneo | 248/188.4 |
| 5,967,472 | A * | 10/1999 | Wilhelmstatter et al. | 248/188.4 |
| 5,971,408 | A * | 10/1999 | Mandel et al. | 280/43.2 |
| 6,601,806 | B2 * | 8/2003 | Wing et al. | 248/188.2 |
| 7,556,227 | B2 * | 7/2009 | Thuelig | 248/188.8 |
| 8,220,760 | B2 * | 7/2012 | Fetzer et al. | 248/188.4 |
| 8,282,053 | B2 * | 10/2012 | Mensching | 248/125.2 |
| 2008/0168855 | A1 * | 7/2008 | Giefer et al. | 74/412 R |
| 2011/0297802 | A1 * | 12/2011 | Gennaretti et al. | 248/188.4 |
| 2012/0280607 | A1 * | 11/2012 | Doberstein et al. | 312/401 |

FOREIGN PATENT DOCUMENTS

WO 2005115199 A1 12/2005

OTHER PUBLICATIONS

European Search Report EP 12 16 1461.
U.S. Appl. No. 13/364,392, filed Feb. 2, 2012.
Search Report issued in Turkish Patent Application No. 2011/03077 mailed on May 21, 2013.

* cited by examiner

*Primary Examiner* — Bradley Duckworth
(74) *Attorney, Agent, or Firm* — Nixon & Vanderhye, P.C.

(57) ABSTRACT

A built-in home appliance includes a panel, a rear foot group having a foot shaft, an adjustment shaft which rotates the foot shaft of the rear foot group, and an adjustment mechanism having a movement transfer mechanism to transfer a rotational movement of the adjustment shaft to the foot shaft. The movement transfer mechanism is provided on a rear part of the panel to adjust a height of the rear foot group. A guiding member having a bearing receives the adjustment shaft and is fixed by a fixation piece to the panel to provide the supporting of the adjustment shaft so that the adjustment shaft essentially extends in a parallel relation to the panel and so that the adjustment shaft extends between a rear part and a front part of the panel.

23 Claims, 5 Drawing Sheets

BUILT-IN HOME APPLIANCE

BACKGROUND OF THE INVENTION

The present invention relates to a built-in home appliance comprising an adjustment shaft which rotates the foot shaft of said rear foot group; and an adjustment mechanism with a movement transfer mechanism which transfers the rotational movement of said adjustment shaft to the foot shaft; in order to adjust the height of at least one rear foot group of a built-in home appliance.

Built-in home appliances become ready for use by being assembled to the housings on the kitchen furniture. Built-in home appliance housings can have slightly different dimensions. Therefore, fine adjustments may have to be realized inside the built-in home appliance housings. First of all, the height adjustment of the built-in home appliance has to be realized. In the present arrangement, height adjustments are realized inside the housing by means of the rear feet where the built-in home appliances stand. Height adjustment of built-in home appliance is realized inside the housing by turning said built-in home appliance from the front side by a steel wire which is in connection with the rear feet. The steel wire is turned by the muscle power of the user. In the process of height adjustment using steel wire, a sensitive adjustment can not be realized.

Another disadvantage of the steel wire is that the system is damaged because of the unbalanced loadings formed during the installation of the built-in home appliance. As a result of the damages formed on the steel wire, the raising mechanism gives error and height adjustment can not be realized. In order to eliminate the errors occurring in the steel wire embodiment, the U.S. Pat. No. 3,534,430 is realized. In said application, the problem is aimed to be solved by using a rigid shaft passing through a fixed nut connected to the sheet where the rear foot wheel is connected. By rotating the shaft which can be accessed from the front side of the built-in home appliance, the height adjustment is provided to be realized. However, the foot realizes the height adjustment by rotating on a screw existing on the plate to which it is connected. In this case, loads from different angles are applied onto the foot and these loads damage the foot.

The applicant has a patent application TR 2011/01953 in order to bring a solution to the abovementioned drawbacks. In this application, in order to adjust the height of at least one rear foot group belonging to a built-in home appliance, an adjustment mechanism is disclosed which is connected to the foot shaft of the rear foot group; and an adjustment shaft is disclosed which provides the required drive for said adjustment mechanism. By means of this, the deteriorations and deformations formed in the raising mechanism during the installation of the built-in home appliance are prevented.

Additional improvements are required for making the mechanism more effective, which is a novel mechanism and which brings pluralities of advantages to the related art.

BRIEF SUMMARY OF THE INVENTION

The present invention relates to a fixation piece for fixing the adjustment shaft onto the built-in home appliance panel, in order to eliminate the drawbacks in the present systems and in order to bring new advantages to the related technical field.

An object of the present invention is to provide the supporting of the adjustment shaft, which is used for adjusting the height of the rear foot group, so as to extend parallel to the ground and/or to the related panel of the home appliance.

Another object of the present invention is to provide the supporting of said adjustment shaft at a point where the user can access.

Another object of the present invention is to provide said adjustment shaft to be fixed to and removed from the point where the adjustment shaft is supported.

In order to realize the abovementioned objects and the objects to be obtained from the detailed description below, the present invention relates to a built-in home appliance comprising an adjustment shaft which rotates the foot shaft of said rear foot group; and an adjustment mechanism with a movement transfer mechanism which transfers the rotational movement of said adjustment shaft to the foot shaft and which is provided on the rear part of the related panel of the home appliance; in order to adjust the height of at least one rear foot group of a built-in home appliance. Said home appliance is characterized by comprising a guiding member with a bearing through which the adjustment shaft passes; and a fixation piece for fixing said guiding member to the panel; in order to provide the supporting of the adjustment shaft so that the adjustment shaft essentially extends in a parallel manner to the home appliance panel and so that the adjustment shaft extends between the rear and the front part of the home appliance panel.

In a preferred embodiment of the present invention, said guiding member has a clip form, in order to provide the removal of the adjustment shaft from the guiding member by a movement which is essentially orthogonal to the extension direction of the panel.

In another preferred embodiment of the present invention, in order to facilitate the releasing of the clip while placing the adjustment shaft to the clip, two extensions are provided where one of the extensions extends towards the ground at the continuation of the clip and where the other extension extends upwardly so as to define a guiding chamber where the adjustment shaft will be guided.

In another preferred embodiment of the present invention, said fixation piece comprises a body which extends substantially orthogonally with respect to the panel and where a guiding member is provided at the end part thereof, in order to position the guiding member at a substantially far point from the panel.

In another preferred embodiment of the present invention, said body has a structure which extends in a waved manner. Thus, the resistance of the body is increased, moreover, the guiding member is provided to be kept at the desired height.

In another preferred embodiment of the present invention, the adjustment shaft comprises a ring, in order to prevent the removal of the adjustment shaft from the guiding member unintentionally in the extension direction of the panel.

In another preferred embodiment of the present invention, a connection plate is provided which provides the fixation of the fixation piece to the panel and which extends essentially parallel to the panel.

In another preferred embodiment of the present invention, at least one screw housing is provided which is embodied on the connection plate and where the connection members, used in the fixation of the fixation piece onto the panel, are screwed.

In another preferred embodiment of the present invention, a support plate is provided which extends between the connection plate and the body.

In another preferred embodiment of the present invention, on the fixation piece, a warning plate is provided which has at least one sign.

In another preferred embodiment of the present invention, said warning plate extends together with the body.

In another preferred embodiment of the present invention, said built-in home appliance is a built-in refrigerator.

DETAILED DESCRIPTION OF EXEMPLARY EMBODIMENTS OF THE PRESENT INVENTION

In this detailed explanation, the subject matter improvement is explained with references to the annexed figures without forming any restrictive effect in order to make the subject more understandable. Accordingly, in the detailed description below, a fixation piece (60) is described which provides the fixation of the adjustment shaft (50), which belongs to the raising mechanism providing the height adjustment of the rear foot group (30) of built-in home appliances, onto the panel (20). However, said fixation piece (60) can also be applied to any home appliance where a similar adjustment shaft (50) is used.

Figure 1:
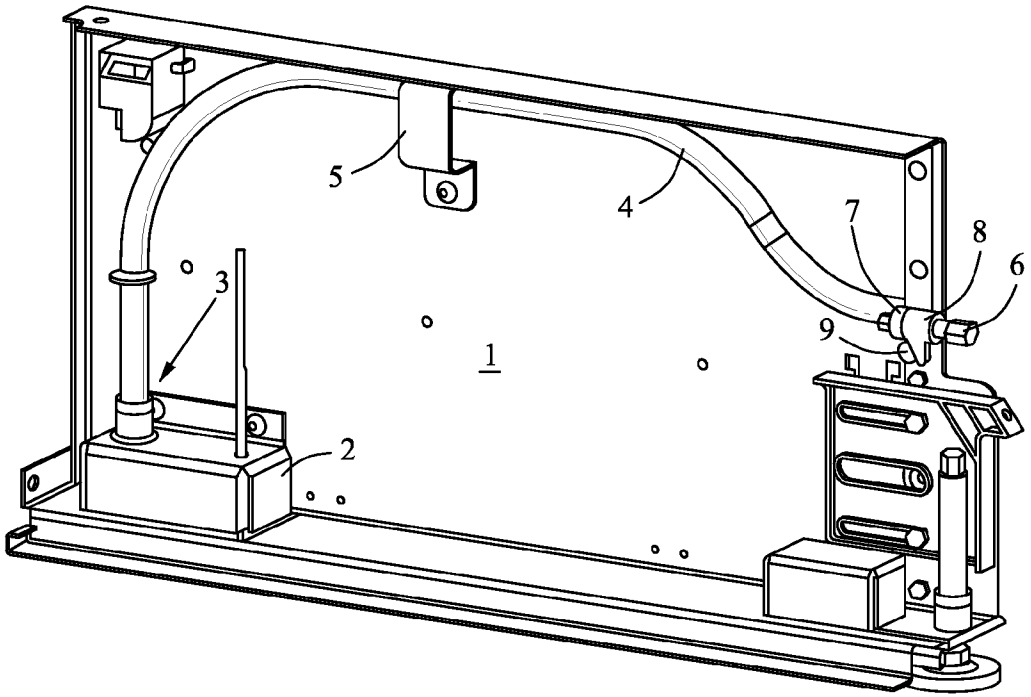
FIG. 1 (Prior Art)
In FIG. 1, the view of the panel group regarding the prior art is given.

With reference to FIG. 1, a built-in home appliance panel (1) belonging to the prior art and the raising mechanism members existing on the panel (1) can be seen. On the panel (1), there is a rear foot group (3); a casing pipe (4) which is in connection with the rear foot group (3); a fixation member (7) for fixing the casing pipe (4) to the front side of the built-in home appliance; and a fixation piece (5) for fixing the casing pipe (4) position inside the panel (1). There is a steel wire (not illustrated in the figure) which is in connection with the foot group (3) and which is housed inside the casing pipe (4). The steel wire has a turning end (6) which extends outwardly from the casing pipe (4) from a point where the fixation member (7) exists. There is a casing chamber (2) which facilitates the positioning of the rear foot group (3) onto the panel (1) and which protects from the external influences.

Figure 2:
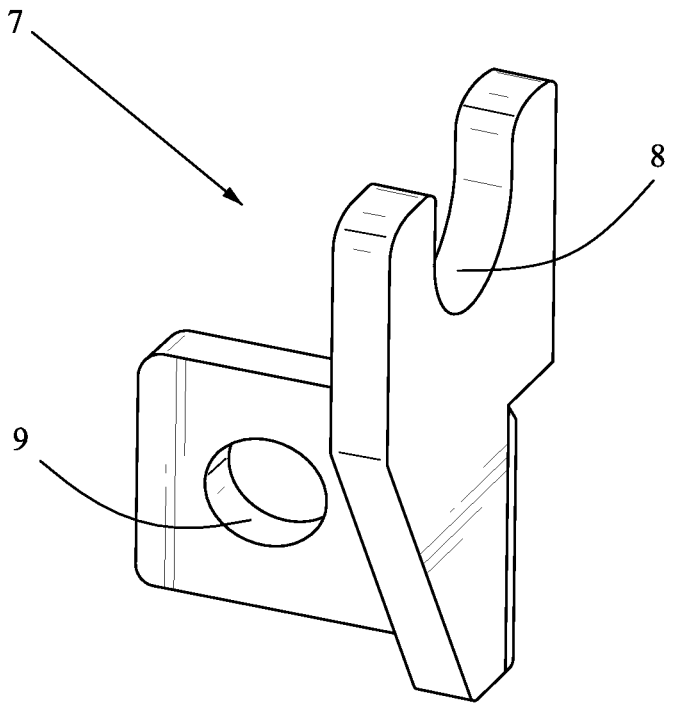
FIG. 2 (Prior Art)
In FIG. 2, the general view of the fixation member regarding the prior art is given.

With reference to FIG. 2, the detailed view of the fixation member (7) is given. The fixation member (7) comprises a connection plate whereon a connection opening (9) is embodied. There is a second plate which extends substantially orthogonally to said connection plate and whereon the fixation housing (8) exists. The casing pipe (4) is placed inside said fixation housing (8).

With reference to FIG. 1 and FIG. 2, in the present arrangement, the height adjustment of the built-in home appliance is realized by means of the steel wire which is connected to the rear foot group (3). The turning end (6), where access to the steel wire is provided, is fixed to the front side of the built-in home appliance with the help of the fixation member (7).

Figure 3:
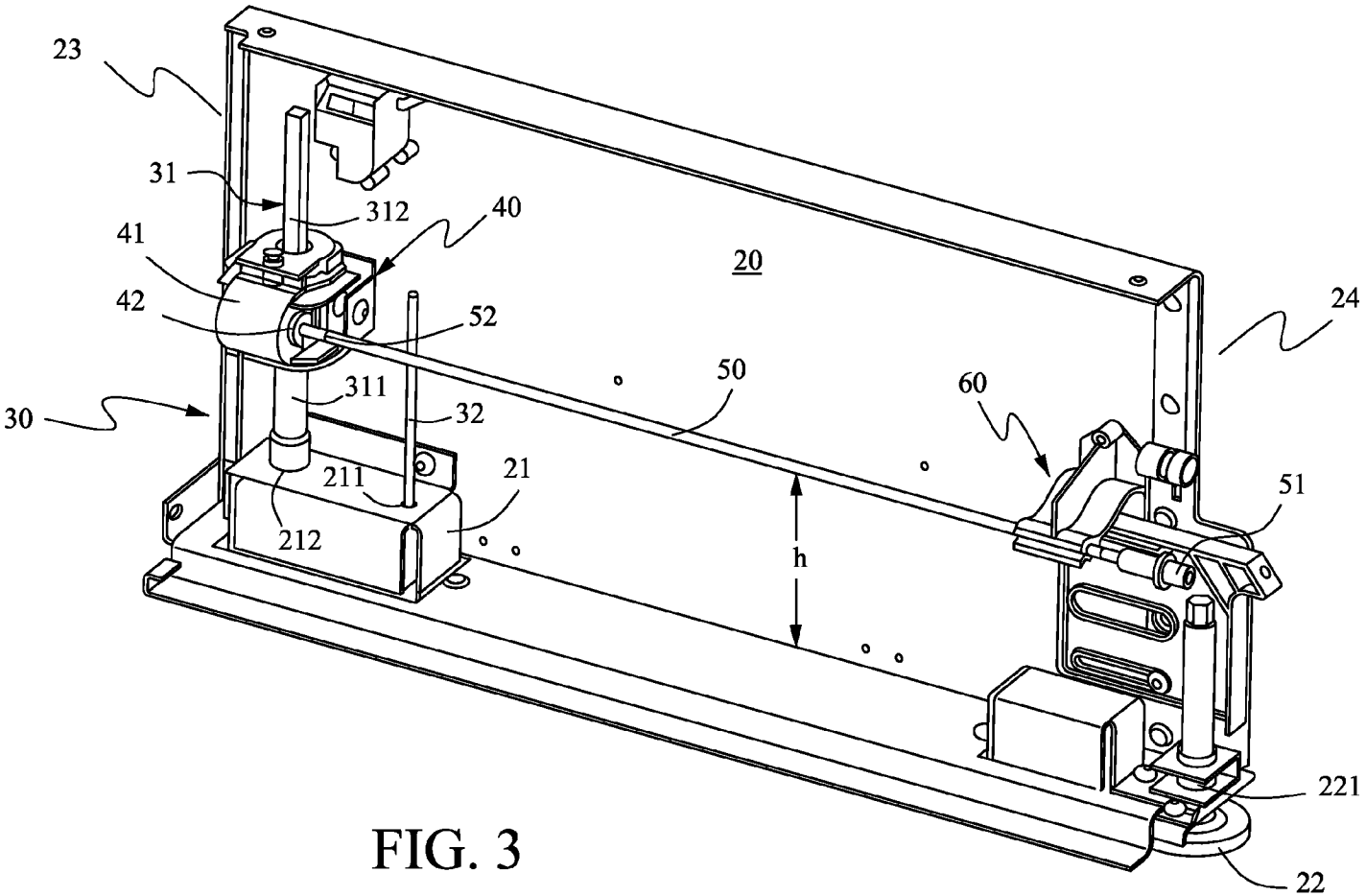
In FIG. 3, the view of the panel group belonging to the novel design is given.

With reference to FIG. 3, the panel (20) belonging to the novel-designed built-in home appliance and the other members thereon can be seen. On the panel (20), there is a rear foot group (30) and there is a movement transfer mechanism (40) which is in connection with the rear foot group (30). On the panel (20), there is a casing chamber (21) which facilitates the positioning of the rear foot group (30) and which protects from external influences. On said casing chamber (21), there is a centering opening (211) and a connection opening (212). On the front side of the panel (20), there is a fixed foot (22) and there is an adjustment screw (221) which is in connection with said fixed foot (22). There is an adjustment shaft (50) which is in connection with the movement transfer mechanism (40). Said adjustment shaft (50) has a substantially rigid structure and it extends parallel to the ground and to the panel (20) and said adjustment shaft (50) extends between a rear part (23), where the rear foot group (30) of the home appliance panel is provided, and a front part (23, 24) where access by the user is possible.

The rear foot group (30) has a foot shaft (31) which extends outwardly from the connection opening (212) and which is in connection with the movement transfer mechanism (40). Said foot shaft (31) comprises a foot screw (311) and an adjustment extension (312) which is embodied so as to extend at the continuation thereof. There is a centering extension (32) which extends outwardly from the centering opening (211) belonging to the rear foot group (30). The movement transfer mechanism (40) has a mechanism body (41) wherein gears and wheels are connected. The movement transfer mechanism (40) has a shaft housing (42) wherein the adjustment shaft (50) is connected. The adjustment shaft (50) has a rotation end (52) which is placed inside said shaft housing (42) and which is embodied with a special form. There is a turning end (51) which is embodied at the other end of the adjustment shaft (50).

Figure 4:
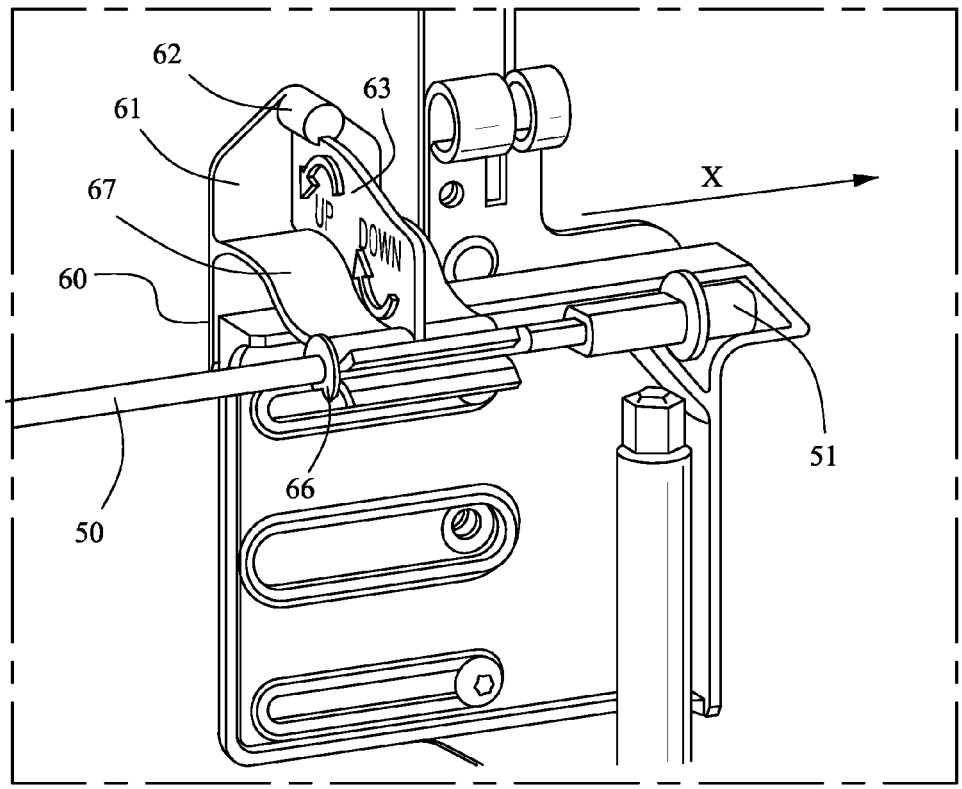
In FIG. 4, the detailed view of the adjustment shaft fixation region belonging to the novel design is given.

With reference to FIG. 4, the connection detail of the adjustment shaft (50) to the front part (24) of the panel (20) is illustrated. The adjustment shaft (50) is connected onto the panel (20) by means of a fixation piece (60). The fixation piece (60) is connected to the panel (20) through a connection plate (61). There is a body (67) which essentially begins from the middle point of the connection plate (61) and which extends orthogonally. Said body (67) has an S like cross section. There is a clip (64), which functions as a guiding member, on the end part of the body (67). The clip (64) comprises a bearing (641) and two extensions (642, 643) extending upwardly and extending at a waved direction with respect to the ground respectively. The adjustment shaft (50) is placed inside the bearing (641) inside the clip (64). There is a ring (66) which is connected onto the adjustment shaft (50) and which is placed inside the clip (64) together with the adjustment shaft (50). The extension styles of said extensions (642, 643) define a guiding chamber (644) which provides the clip (64) to be opened in an easier manner as a result of the pressure of the adjustment shaft (50). On the other hand, the guiding member (64) has a height (h) so as to support the adjustment shaft (50) in a parallel manner to the ground; and the fixation piece (60) is fixed to the panel (20) so as to provide this.

Figure 6:
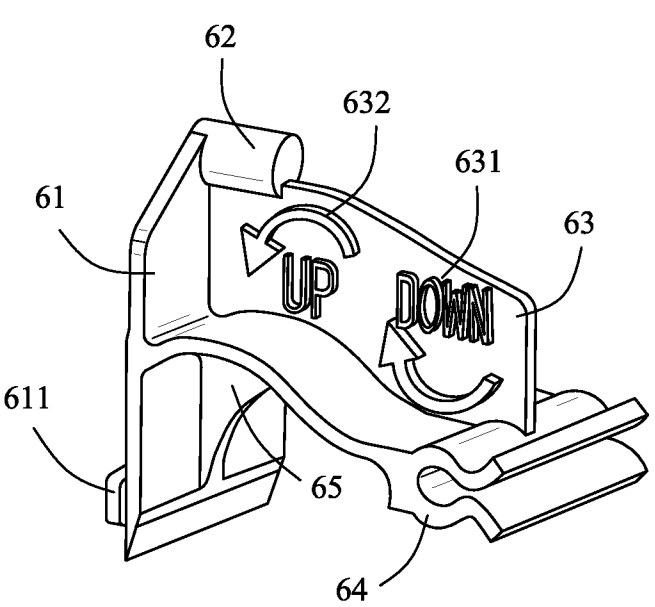
In FIG. 6, the general view of the fixation member belonging to the novel design is given.
Figure 5:
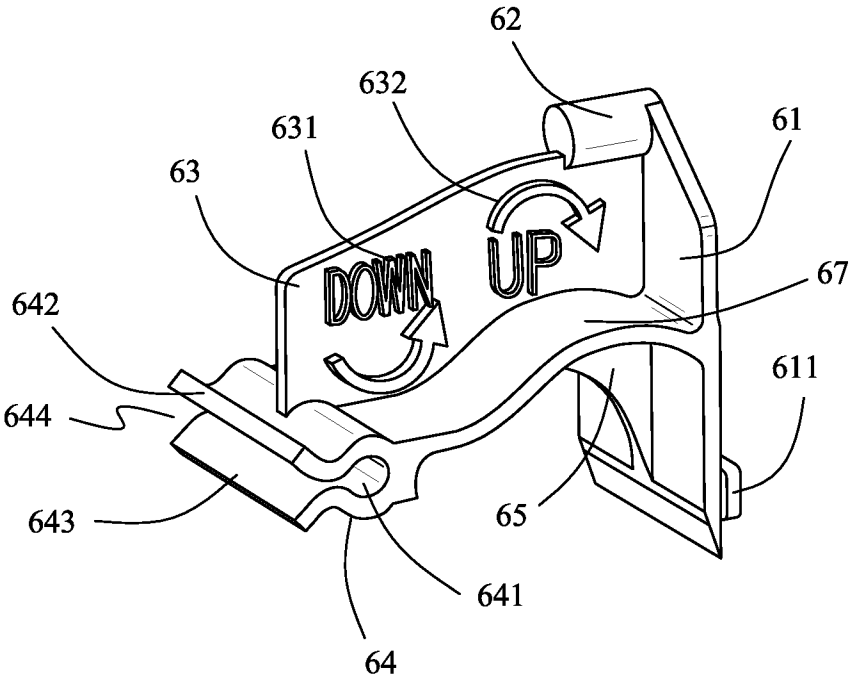
In FIG. 5, the general view of the fixation member belonging to the novel design is given.

With reference to FIG. 5 and FIG. 6, the detailed view of the fixation piece (60) is given. The connection plate (61) extends longitudinally in a parallel manner to the panel (20) and it is in the form of a rectangle whose upper corners are cut so as to define a triangular part. On the upper point of said triangular part of the connection plate (61), there is a screw housing (62) and there is a connection extension (611) at the bottom part of the connection plate (61).

On the upper surface of the body (67), a warning plate (63) extends along the body (67). Said warning plate (63) has a height which extends until the screw housing (62). There is a first sign (631) and a second sign (632) embodied on the warning plate (63). Moreover, there is a support plate (65) which is provided between the bottom part of the connection plate (61) and the surface of the body facing the ground; and said support plate (65) extends in belt form.

With reference to FIG. 4, the assembly of the abovementioned fixation piece (60) onto the panel (20) is realized by connecting a screw to the screw housing (62) after placing the connection extension (611) to the housing (not illustrated in the figure) on the panel (20). The clip (64) provides a bearing (641) for the adjustment shaft (50) and at the same time, the clip (64) functions as a guiding member for the adjustment shaft (50). By means of this, the adjustment shaft (50) is provided to obtain a suitable parallelism with respect to the ground. The first and the second extensions (642, 643) on the clip (64) provide the adjustment shaft (50) to remain inside the bearing (641) in the horizontal direction. The resistance of the first and the second extension (642, 643) has a level so as to keep the adjustment shaft (50) inside the bearing (641) in the horizontal direction. The ring (66), which is connected onto the adjustment shaft (50), is housed inside the clip (64) together with the adjustment shaft (50). The adjustment shaft (50) is housed inside the clip (64) in a movable manner. Thus, when the user pulls the adjustment shaft (50) in the x direction towards himself/herself, the adjustment shaft (50) can get out of the clip (64). The ring (66) prevents the adjustment shaft (50) from being removed from the bearing (641) in the x direction. The signs (631, 632) on the warning plate (63) show the adjustment shaft (50) turning directions and in correspondence to this, the raising and the lowering directions are illustrated by the signs (631, 632). By means of this, the users will learn that the built-in home appliance will realize lowering or raising movement according to the direction which the users turn the adjustment shaft (50). In case a force is applied on the body (67), the support plate (65) helps the body (67) to preserve the position thereof. Since the body (67) has an S like cross section, the clip (64) is provided to the positioned at the desired point in the vertical direction.

In the alternative embodiment of the subject matter invention, different embodiments can be used for realizing guidance instead of the clip (64) on the fixation piece (60). Inside these embodiments, instead of the clip (64), a hollow cylindrical embodiment like a collar clamp can also be used.

As a result, the protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

What is claimed is:

1. A built-in home appliance, comprising:

a panel;

a rear foot group having a foot shaft;

an adjustment shaft which rotates the foot shaft of the rear foot group;

a movement transfer mechanism to transfer a rotational movement of the adjustment shaft to the foot shaft, said movement transfer mechanism provided on a rear part of the panel to adjust a height of the rear foot group;

a guiding member having a bearing through which the adjustment shaft passes; and a fixation piece for fixing the guiding member to the panel in order to provide the supporting of the adjustment shaft so that the adjustment shaft essentially extends in a parallel relation to the panel and so that the adjustment shaft extends between a rear part and a front part of the panel, wherein the fixation piece comprises a body, said guiding member being provided at an end part of the body that is opposed from the panel, wherein the body has a structure which extends in a waved manner substantially orthogonally with respect to the panel.

2. The built-in home appliance of claim 1, wherein the guiding member comprises a clip adapted to allow removal of the adjustment shaft from the guiding member by a movement which is essentially orthogonal to an extension direction of the panel.

3. The built-in home appliance of claim 2, wherein the clip has two extensions to facilitate a release of the clip while placing the adjustment shaft to the clip, one of the extensions extending towards the ground, and the other one of the extensions extending upwardly to define with the one of the extensions a guiding chamber for guiding the adjustment shaft.

4. The built-in home appliance of claim 1, wherein the adjustment shaft comprises a ring to prevent unintentional removal of the adjustment shaft from the guiding member in an extension direction of the panel.

5. The built-in home appliance of claim 1, further comprising a connection plate for fixation of the fixation piece to the panel, said connection plate extending essentially parallel to the panel.

6. The built-in home appliance of claim 5, further comprising at least one screw housing on the connection plate for threaded engagement of a connection member to fix the fixation piece to the panel.

7. The built-in home appliance of claim 5, wherein the fixation piece comprises a body which extends substantially orthogonally with respect to the panel, and further comprising a support plate extending between the connection plate and the body.

8. The built-in home appliance of claim 1, wherein the fixation piece includes a warning plate having at least one sign.

9. The built-in home appliance of claim 8, wherein the fixation piece comprises a body which extends substantially orthogonally with respect to the panel, said warning plate extending together with the body.

10. The built-in home appliance of claim 1, wherein the guiding member has a height sufficient to support the adjustment shaft in a parallel extending manner when the fixation piece is fixed to the panel.

11. The built-in home appliance of claim 1, constructed in the form of a built-in refrigerator.

12. A built-in home appliance, comprising:

a panel;

a rear foot group having a foot shaft;

an adjustment shaft which rotates the foot shaft of the rear foot group;

a movement transfer mechanism to transfer a rotational movement of the adjustment shaft to the foot shaft, said movement transfer mechanism provided on a rear part of the panel to adjust a height of the rear foot group;

a guiding member having a bearing through which the adjustment shaft passes; and a fixation piece for fixing the guiding member to the panel in order to provide the supporting of the adjustment shaft so that the adjustment shaft essentially extends in a parallel relation to the panel and so that the adjustment shaft extends between a rear part and a front part of the panel, wherein the fixation piece includes a plate having at least one instructional sign.

13. The built-in home appliance of claim 12, wherein the guiding member comprises a clip adapted to allow removal of the adjustment shaft from the guiding member by a movement which is essentially orthogonal to an extension direction of the panel.

14. The built-in home appliance of claim 13, wherein the clip has two extensions to facilitate a release of the clip while placing the adjustment shaft to the clip, one of the extensions extending towards the ground, and the other one of the extensions extending upwardly to define with the one of the extensions a guiding chamber for guiding the adjustment shaft.

15. The built-in home appliance of claim 12, wherein the adjustment shaft comprises a ring to prevent unintentional removal of the adjustment shaft from the guiding member in an extension direction of the panel.

16. The built-in home appliance of claim 12, further comprising a connection plate for fixation of the fixation piece to the panel, said connection plate extending essentially parallel to the panel.

17. The built-in home appliance of claim 16, further comprising at least one screw housing embodied on the connection plate for threaded engagement of a connection member to fix the fixation piece to the panel.

18. The built-in home appliance of claim 16, wherein the fixation piece comprises a body which extends substantially orthogonally with respect to the panel, and further comprising a support plate extending between the connection plate and the body.

19. The built-in home appliance of claim 12, wherein the fixation piece comprises a body which extends substantially orthogonally with respect to the panel, said plate extending together with the body.

20. The built-in home appliance of claim 12, wherein the guiding member has a height sufficient to support the adjustment shaft in a parallel extending manner when the fixation piece is fixed to the panel.

21. The built-in home appliance of claim 12, constructed in the form of a built-in refrigerator.

22. A built-in home appliance, comprising:

a panel;

a rear foot group having a foot shaft;

an adjustment shaft which rotates the foot shaft of the rear foot group;

a movement transfer mechanism to transfer a rotational movement of the adjustment shaft to the foot shaft, said movement transfer mechanism provided on a rear part of the panel to adjust a height of the rear foot group;

a guiding member having a bearing through which the adjustment shaft passes;

a fixation piece for fixing the guiding member to the panel in order to provide support for the adjustment shaft so that the adjustment shaft essentially extends in a parallel relation to the panel and so that the adjustment shaft extends between a rear part and a front part of the panel; and a detachable ring attached to the adjustment shaft to prevent movement of the adjustment shaft from the guiding member in an extension direction of the panel.

23. The built-in home appliance of claim 22, wherein the detachable ring contacts the guiding member.

* * * * *